US006014937A

United States Patent [19]

Lovelady

[11] Patent Number: 6,014,937

[45] Date of Patent: Jan. 18, 2000

[54] FINE GAUGE TUFTING MACHINE WITH STAGGERED NEEDLE BAR

[75] Inventor: Brian K. Lovelady, Soddy-Daisy, Tenn.

[73] Assignee: Tuftco Corporation, Chattanooga, Tenn.

[21] Appl. No.: 08/987,784

[22] Filed: Dec. 9, 1997

Related U.S. Application Data

[63] Continuation-in-part of application No. 08/223,851, Apr. 6, 1994, abandoned.

[51] Int. Cl.[7] ..... D05C 15/30

[52] U.S. Cl. ..... 112/80.41; 112/80.5

[58] Field of Search ..... 112/80.5, 80.6, 112/80.52, 80.4, 80.41, 80.16

[56] References Cited

U.S. PATENT DOCUMENTS

| | | | |
|---|---|---|---|
| 3,019,748 | 2/1962 | Card | 112/80.4 |
| 3,443,534 | 5/1969 | Lund . | |
| 3,850,120 | 11/1974 | Jackson | 112/80.5 X |
| 4,067,270 | 1/1978 | Short . | |
| 4,158,339 | 6/1979 | Short . | |
| 4,217,837 | 8/1980 | Beasley et al. . | |
| 4,419,944 | 12/1983 | Passons et al. . | |
| 4,448,137 | 5/1984 | Curtis et al. . | |
| 4,480,563 | 11/1984 | Beyer et al. | 112/80.16 X |
| 4,503,787 | 3/1985 | Watkins . | |
| 4,519,326 | 5/1985 | Green et al. . | |
| 4,580,510 | 4/1986 | Hirose | 112/80.5 |
| 4,829,917 | 5/1989 | Morgante et al. | 112/80.41 |
| 4,841,886 | 6/1989 | Watkins | 112/80.3 |
| 5,193,472 | 3/1993 | Crossley | 112/80.41 |
| 5,224,434 | 7/1993 | Card et al. | 112/80.41 |

FOREIGN PATENT DOCUMENTS

| | | |
|---|---|---|
| 0051737A1 | 5/1982 | European Pat. Off. . |
| 0587094A1 | 3/1994 | European Pat. Off. . |
| 4214516A1 | 11/1992 | Germany . |
| 1367410 | 9/1974 | United Kingdom . |
| 1406206 | 9/1975 | United Kingdom . |
| 1438173 | 6/1976 | United Kingdom . |
| 1543822 | 4/1979 | United Kingdom . |
| 2255785A | 11/1992 | United Kingdom . |

*Primary Examiner*—Ismael Izaguirre
*Attorney, Agent, or Firm*—Douglas T. Johnson

[57] ABSTRACT

A tufting machine with two rows of needles may be mounted staggered relative to each other on a single needle bar is provided with a single row of loopers cooperable with either or both rows of needles. The rows of needles are longitudinally spaced by a relatively narrow distance. Hollow ground loopers are used in conjunction with maximum target area needles and a needle plate with a serrated edge rather than needle plate fingers, to improve the operation of the tufting machine, particularly when the rows of needles are spaced transversely at a relatively fine gauge. This permits the efficient operation of a fine gauge tufting machine in which rows of needles can be shifted in distances of the composite needle gauge thereby improving finish, reducing backstitch yarn, increasing machine speed, and even reducing wasted face yarn when used with fixed yarn feed mechanisms.

39 Claims, 6 Drawing Sheets

6°
6°
6°
55
56
57
58
59
60
61
62
63
65
66
67
68
69
70
71
72
73

FINE GAUGE TUFTING MACHINE WITH STAGGERED NEEDLE BAR

This application is a continuation-in-part of prior application Ser No. 08/223,851 filed Apr. 6, 1994, now abandoned.

BACKGROUND OF THE INVENTION

This invention relates to tufting machines and more particularly to an improved tufting machine for fine gauge tufting, having at least two transverse rows of needles and only one row of hooks or loopers to seize the yarn from the needles.

There is a continual effort in the tufting machine industry to produce machines that will operate faster, create patterns with a novel appearance, create patterns with a very fine gauge, create patterns with a minimum of yarn used in the backstitch, and create patterns of a uniform appearance which may both conceal irregularities in the yarn and reduce the necessity for further processing such as shearing to improve the finished carpets' appearance.

In order to further these goals, the tufting industry has devised a variety of improvements ranging from yarn feed control attachments to produce patterns and provide measured amounts of yarn for each stitch, to staggered needle bars to allow a finer gauge, shiftable needle bars to produce patterns and even multiple shiftable needle bars.

A staggered needle bar typically consists of two rows of needles extending transversely across the tufting machine. The rows of needles are generally spaced 0.25 inches apart in the longitudinal direction and are offset so that the needles in the rear transverse row are longitudinally spaced between the needles in the front transverse row. In operation the needle bar is reciprocated so that the needles penetrate and insert loops of yarn in a backing material fed longitudinally beneath the needles. The loops of yarn are seized by loopers or hooks moving in timed relationship with the needles beneath the fabric. In most staggered needle bar tufting machines, there are front loopers which cooperate with the front needles and rear loopers which cooperate with the rear needles. These loopers may be mounted in a single row with the front loopers being approximately 0.25 inches longer, in the case of a cut pile tufting machine, (or the rear loopers being longer in a loop pile machine) as shown in U.S. Pat. Nos. 4,067,270 and 4,519,326. One disadvantage to the longer front loopers in a cut pile tufting machine is that the front loopers will hold several more loops of yarn than the rear loopers and as a result will tend to back-rob a slightly different amount of yarn leading to a corn-rowing effect. This sometimes requires the cut pile carpet to be sheared to an even finish after tufting. Alternatively, in a loop pile machine, it may be possible to have two separate rows of loopers such as those illustrated in U.S. Pat. No. 4,841,886 where loopers in the front hook bar cooperate with the front needles and loopers in the rear hook bar cooperate with rear needles. Similar looper construction have been used in tufting machines with separate independently shiftable front and rear needle bars, so that there are specifically designated front loopers to cooperate with front needles and specifically designated rear loopers to cooperate with rear needles.

The result of having loopers co-operable with only a given row of needles on a fine gauge tufting machine with either a staggered needle bar or two independently shiftable needle bars is that it is only possible to move a particular needle laterally by a multiple of the gauge of the needles on the relevant needle bar. Thus for a fairly common 0.20 inch gauge row of needles with corresponding loopers set at 0.20 inch gauge, the needles must be shifted in increments of 0.20 inches. This is so even though in a staggered needle bar with two rows of 0.20 inch gauge needles the composite gauge of the staggered needle bar is 0.10 inch gauge. The necessity of shifting the rows of needles twice the gauge of the composite needle assembly results in patterns with less definition than could be obtained if it were possible to shift in increments of the composite gauge.

One effort to reduce the gauge of tufting has been to use smaller and more precise parts. For instance, Green, U.S. Pat. No. 4,519,326, is directed to an improved needle bar that was easier to manufacture and provided more accurate transverse needle gauge. The needle bars of this invention would typically consist of either single transverse row of needles or two staggered and longitudinally spaced transverse rows of needles. The usual longitudinal spacing between the two staggered rows of needles would be at least 0.1875 inches. Staggered needle bars according to U.S. Pat. No. 4,519,326 were intended for use on tufting machines with a backing fabric feed, a needle drive, either one or two rows of loopers (but if used with a single row of loopers, the loopers would have different length necks), and a needle bar shifting mechanism such as shown in Morgante, U.S. Pat. No. 4,829,917. The invention of U.S. Pat. No. 4,519,326 taught neither the close longitudinal spacing (less than 0.157 inches) of the two transverse rows of staggered needles, nor the use of a single row of loopers having necks of equal length so that the loopers could seize yarns from either transverse row of needles.

In order to overcome the problem of double gauge shifting, U.S. Pat. No. 5,224,434 suggests a tufting machine with front loopers spaced equal to the composite gauge and rear loopers spaced equal to the composite gauge. Thus on a tufting machine with two rows of 0.20 inch gauge needles there would be a row of front loopers spaced at 0.10 inch gauge and a row of rear loopers spaced at 0.10 inch gauge. Although this allows the shifting of each row of needles in increments equal to the composite gauge, this solution is limited in that the front needles can only be used to create loop pile and the rear needles can only be used to create cut pile.

An alternative arrangement is proposed in U.S. Pat. No. 5,193,472 where a single row of loopers can cooperate with either the row of needles on a front needle bar or the row of needles on a rear needle bar, the needle bars being closely positioned so that the rows of needles are longitudinally spaced about 0.125 inches apart, or a variation thereof in U.K. Patent Application 2255785A wherein the loopers can also cooperate with both rows of needles simultaneously. Although presenting a conceptual improvement, actual operation of such a tufting machine presents numerous practical difficulties which have not been addressed. For instance, when the looper crosses the first needle, it is deflected somewhat and when crossing the second needle it may split the yarn or fail to pick up the yarn entirely. Although in U.S. Pat. No. 3,443,534 a similar problem was solved by offsetting the second row of needles, when dealing with a 0.10 inch composite gauge tufting machine there is not sufficient space for such an offset. Furthermore, because the second row of needles is crossed later in the stitch cycle, the timing of the looper meeting the second needle is slightly altered. The use of conventional needle plates with fingers extending beneath the backing fabric and between the needles also tends to pinch the yarn resulting in irregularities in the finished carpet.

When originally developed in the 1970s, staggered needle bar cut pile tufting machines were used to produce some new carpet patterns. However, the types of patterns that could be produced by these machines were limited. Today, dual shiftable needle bar tufting machines and/or scroll attachments are generally used to tuft patterned carpet. At present, the primary use of staggered needle bar tufting machines is for the tufting of solid color carpets, often using relatively inexpensive yarns. Inexpensive yarns frequently contain streaks of lighter or darker color. By shifting a staggered needle bar threaded with a single color of yarns, the yarns from the first transverse row of needles will cross with the yarns from the second transverse row of needles and any streaks in a yarn will be tufted in rows with yarns from other needles so that streaking will not be apparent in the finished carpet. In tufting such a solid color carpet, pattern definition is of absolutely no concern.

Instead, some of the principal concerns are yarn savings, speed of operation, and better carpet finish. Each of these concerns is a problem or goal which has been long recognized in the tufting industry. Tufting machine purchasers and operators are always interested in reducing their raw material costs, gaining increased carpet output through faster machine operation, and minimizing blemishes on finished carpet such as corn rowing without the necessity of extra processing. The present invention addresses these concerns.

SUMMARY OF THE INVENTION

It is therefore an object of the invention to provide an improved tufting machine with two staggered rows of transversely spaced needles on a single needle bar cooperating with a single row of loopers.

It is another object of the present invention to provide a tufting machine with two staggered rows of needles on a single needle bar permitting lateral shifting of each row of transversely spaced needles by an amount equal to the composite gauge of both rows of needles, whereby the smaller lateral shifts result in patterns with improved finish and reduced yarn consumption in the backstitch.

It is a further object of this invention to place two staggered rows of transverse needles on a single needle bar in longitudinal proximity so as to reduce the corn-rowing effect and reduce the need for tip shearing to finish the tufted carpet.

It is yet another object of the present invention to provide for the manufacture of fine gauge carpeting with a reduced number of irregularities caused by loopers splitting yarn or missing yarn pickups, and by needle plate fingers pinching yarn.

Accordingly, the present invention utilizes hollow ground loopers to minimize the deflection caused by crossing the first needles and also utilizes second needles having a thicker scarf and lowered slightly to compensate for the loopers crossing the second needles later in the stitch cycle. The present invention also provides for the first and second rows of needles to be longitudinally displaced by a short distance on the order of 0.125 to 0.1563 inches to minimize the "corn-rowing" effect. Also used is a needle plate with a serrated front edge matching the composite needle gauge, such needle plate is preferably without fingers extending beneath the backing fabric and between the needles.

DETAILED DESCRIPTION OF THE DRAWINGS

Figure 1A:
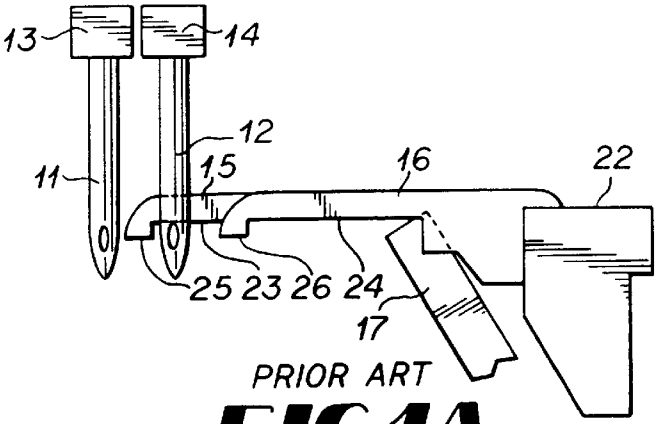
PRIOR ART FIG 1A
FIG. 1A is a side elevation view of a prior art needle and looper assembly for making cut pile carpet with two transverse rows of longitudinally offset needles.

FIG. 1A is a representation of the hooks or loopers and needles of a prior art tufting machine with two independently shiftable needle bars. Front needle bar 13 supports a row of front needles 11 extending transversely to the direction of the backing fabric feed. Rear needle bar 14 supports a row of rear needles 12 also extending transversely to the direction of the backing fabric feed. The front and rear needle bars 13, 14 are adapted to reciprocably move between a lower position disclosed in FIG. 1A, to an upper position, not shown, in which the needles 11 and 12 are above the base fabric. The needle bars 13 and 14 are driven by conventional means not shown.

Front loopers 15 are supported upon hook bar 22 for reciprocal movement by conventional means, not shown. Each front looper 15 includes an elongated throat 23 which projects in a direction opposite to the fabric feeding direction and with a down turned bill 25. When the tufting machine is in operation, front loopers 15 cross front needles 11 in their lower position and seize loops of yarn, not shown, which are retained on the throat 23 of the front loopers 15 and moved in the fabric feeding direction toward the knives 17 forming the cutting apparatus. Each rear looper 16 includes a relatively shorter throat 24 and a downturned bill 26. Rear loopers 16 are reciprocated to cross rear needles 12 in their lower position and seize loops of yarn, not shown, which are retained on the throat 24 and moved in the fabric feeding direction toward knives 17. The longer throats 23 of front loopers 15 retain several additional loops of yarn relative to the shorter throats 24 of rear loopers 16 with the result of varying the backrobbing effect between the two rows of loops which produces a corn rowed appearance to the cut pile tufted surface which is frequently severe enough to require tip shearing as an additional step in finishing the cut pile carpet.

Figure 1B:
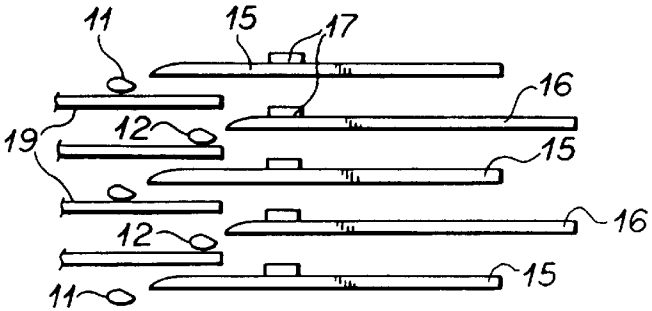
PRIOR ART FIG 1B
FIG. 1B is a top sectional view of the prior art needle and looper assembly of FIG. 2A.

FIG. 1B shows the orientation of the front and rear needles, 11 and 12, and front and rear loopers 15 and 16, and needle plate fingers 19 from a top view. Because front loopers 15 correspond only with front needles 11, and rear loopers 16 only with rear needles 12, needles must be shifted in units of twice the gauge of the composite needle bar.

Figure 2A:
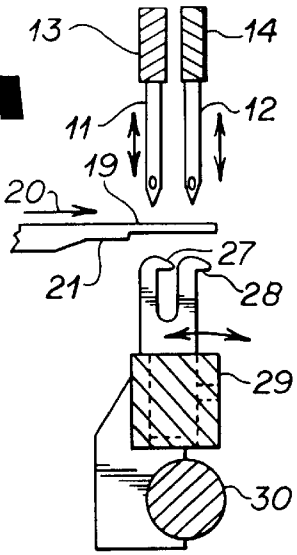
PRIOR ART FIG 2A
FIG. 2A is a side elevation view of a prior art needle and looper assembly for making loop pile carpet with two transverse rows of longitudinally offset needles.

FIG. 2A shows a prior art loop pile tufting machine with front needle bar 13 supporting front needles 11 and rear needle bar 14 supporting rear needles 12 in an upper position. Backing fabric, not shown, is fed over needle plate 21 in direction 20 and supported by needle plate fingers 19 in the area where needles 11 and 12 penetrate the backing fabric. When needles 11 and 12 are driven downward into a lower position by conventional means to penetrate the backing fabric, front loopers 27 and rear loopers 28 mounted in hook bar 29 are reciprocated to cross front needles 11 and rear needles 12 respectively.

Figure 2B:
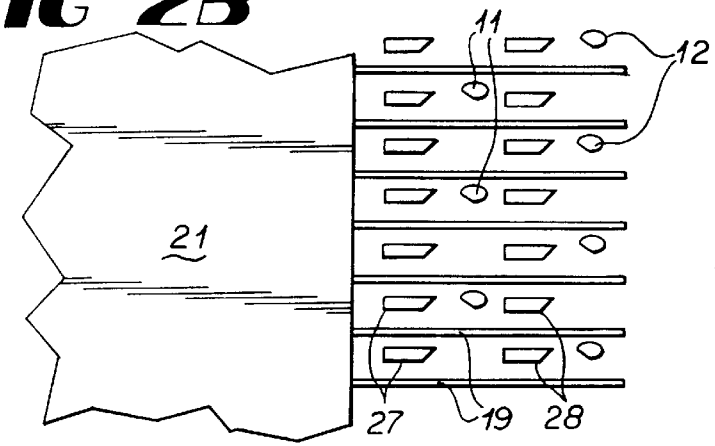
PRIOR ART FIG 2B
FIG. 2B is a top sectional view of the prior art needle and looper assembly of FIG. 2A.

The hook bar 24 is reciprocated by conventional means, not shown, acting on rocker shaft 30, so that loopers 27 and 28 seize and release loops of yarn thereby forming loop pile tufts on the bottom surface of the backing fabric. FIG. 2B shows the arrangement of needles 11 and 12, and loopers 27 and 28 from the top, with needle plate fingers 19. Because the loopers 27 and 28 are spaced at the composite gauge of both front and rear needles, either front needles 11 or rear needles 12 may be shifted in increments of the composite needle gauge. This provides a satisfactory solution to produce high definition loop pile carpets but because it is necessary to have a cutting apparatus associated with the loopers to produce cut pile carpet, utilizing a similar mechanism to produce cut pile would require substantial spacing between the front and rear needles. However, when there is substantial spacing between the front and rear needles, it is difficult to keep the stitches of the front and rear needles in exact alignment so that precise patterns cannot be produced.

Figure 3A:
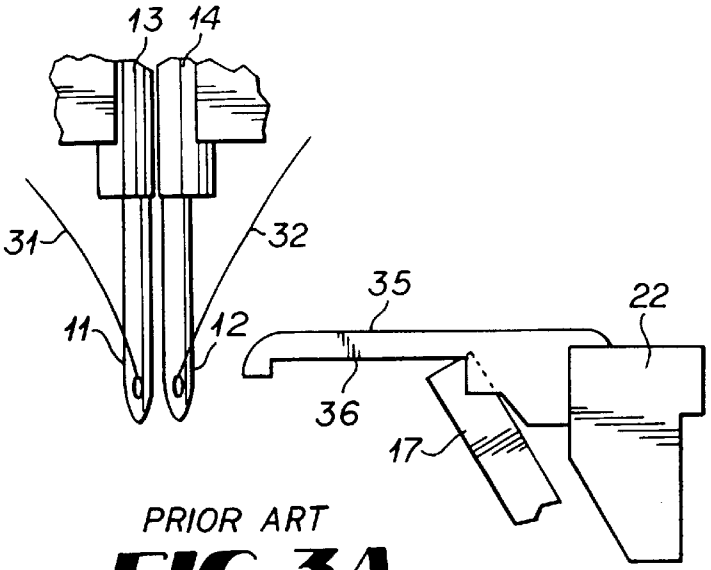
PRIOR ART FIG 3A
FIG. 3A is a side elevation view of a prior art tufting machine with two independently shiftable needle bars with a single set of loopers and knives.
Figure 3B:
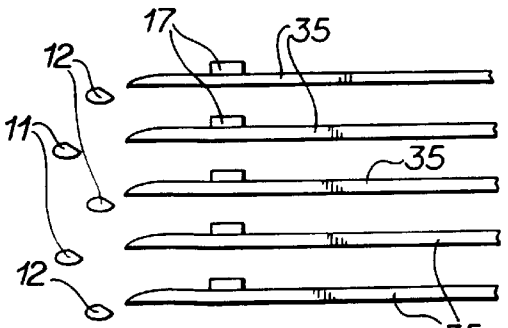
PRIOR ART FIG 3B
FIG. 3B is a top sectional view of the tufting machine of FIG. 3A.

FIGS. 3A and 3B illustrate another prior art tufting machine which attempts to provide a solution allowing the production of high definition cut pile carpet. Once more front needles 11 are supported on front needle bars 13 and rear needles 12 are supported on rear needle bars 14 for reciprocation through a backing fabric. Loopers 35 are spaced at the composite needle gauge of front and rear needles 11 and 12 and are designed to cooperate with either front needles 11 or rear needles 12 to seize loops of yarn. In this fashion, front needles 11 and rear needles 12 can be shifted in increments equal to the composite needle gauge. Loops of yarn seized on loopers 35 are then moved in the direction of the fabric feed toward knives 17 which cut the yarn to create cut pile carpet. Although the mechanism illustrated in FIGS. 3A and 3B would appear to provide a satisfactory mechanism to produce high definition cut pile carpet in practice this mechanism does not perform satisfactorily when the composite needle gauge approaches 0.10 inch gauge.

Figure 3D:
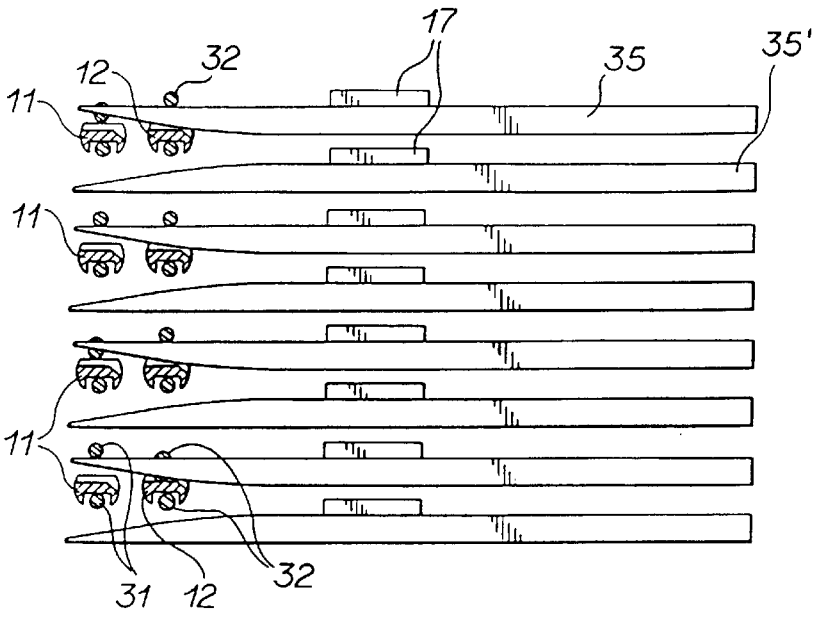
PRIOR ART FIG 3D
FIG. 3D is a top sectional view of the tufting machine of FIG. 3A showing loopers being deflected when crossing a first row of needles and splitting yarn or missing yarn pickups when crossing a second row of longitudinally aligned needles.
Figure 3C:
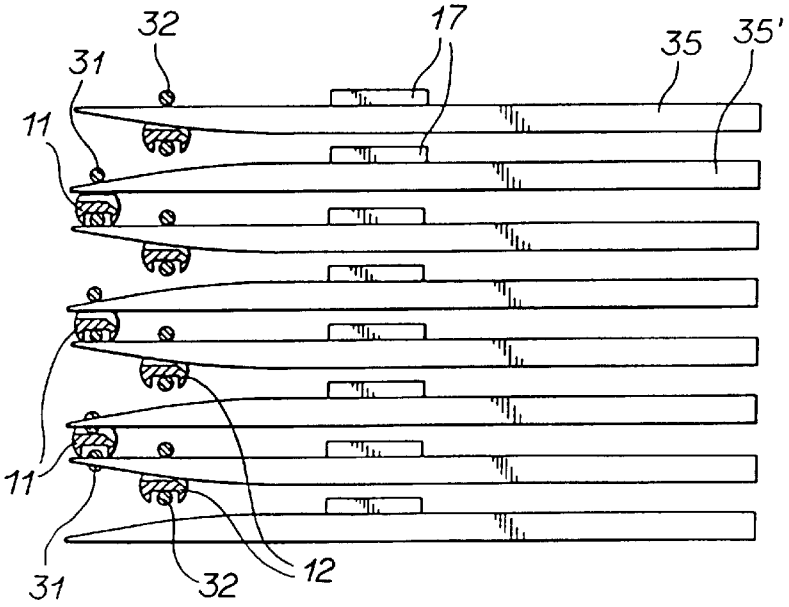
PRIOR ART FIG 3C
FIG. 3C is a top sectional view of the tufting machine of FIG. 3A showing loopers being deflected when crossing a first row of needles and becoming wedged against a second row of staggered needles.
Figures 6A, 6B, 6C, 6D, 6E, 7A, 7B, 7C, 7D, 7E:
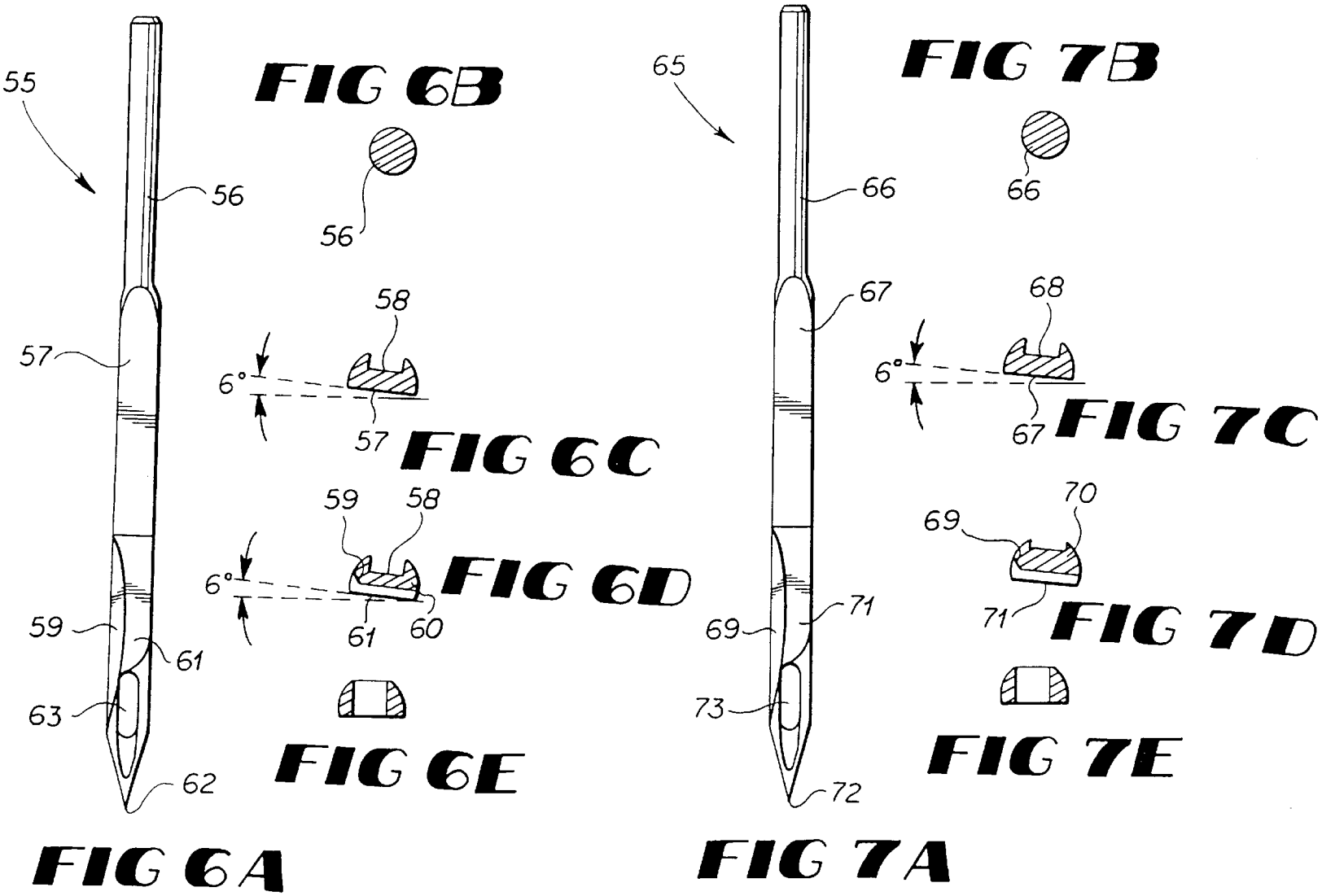
FIG. 6A is a side elevation view of a standard tufting needle.
FIG. 6B is an enlarged cross sectional view of the shank of a standard tufting needle.
FIG. 6C is an enlarged cross sectional view of the blade of a standard tufting needle.
FIG. 6D is an enlarged cross sectional view of the scarf of a standard tufting needle.
FIG. 6E is an enlarged cross sectional view of the aperture of a standard tufting needle.
FIG. 7A is a side elevation view of a maximum target area tufting needle adapted for use in the second row of needles according to the present invention.
FIG. 7B is an enlarged cross sectional view of the shank of a maximum target area tufting needle.
FIG. 7C is an enlarged cross sectional view of the blade of a maximum target area tufting needle.
FIG. 7D is an enlarged cross sectional view of the scarf of a maximum target area tufting needle.
FIG. 7E is an enlarged cross sectional view of the aperture of a maximum target area tufting needle.

The first difficulty encountered in operation is that the needle plate fingers 19 tend to pinch the yarn as it is carried below the backing fabric by needles 11 and 12. The second difficulty is that the loopers 35 cross the first row of rear needles 12 earlier in the stitch cycle than the second row of front needles 11, so that the loopers 35 do not cross both rows of needles at the preferred yarn pick up spot. The third difficulty in fine gauge operation is caused by the deflection of loopers 35 when crossing the first row of needles 12 as illustrated in FIGS. 3C and 3D. There is only a very limited transverse space between front needles 11 offset from rear needles 12, when both front and rear needles are transversely spaced at a relatively narrow gauge less than 0.25 inches and typically 0.20 inches. The transverse spacing is reduced even further because the needles are rotated so that the needle blades and yarn pickup spots are at an angle of approximately 6°, as shown in FIGS. 6C and 6D which increases the effective width of the needles. As shown in FIG. 3C when the front needles 11 and rear needles 12 are in offset alignment, loopers 35 crossing the first row of rear needles 12 tend to be deflected away so that the side of the looper 35 adjacent to the knife 17 will frequently come into contact with the yarn groove side of front needles 11 in the second row. The effect of loopers 35 contacting the yarn groove side of the front needles 11 is to wedge the loopers 35 between offset front needles 11 and rear needles 12 thereby increasing resistance to operation of the tufting machine so much that conventional needle drive mechanisms provide inadequate power to effectively operate the machine. Also, the contact between needles and loopers tends to increase the incidence of breakage.

When the front needles 11 and rear needles 12 are in alignment as shown in FIG. 3D, loopers 35 crossing over the first rear row of needles 12 are deflected so that there is a tendency for the looper 35 to either miss the yarn pickup from the front needles 11 or to split the yarns carried by the front needles 11 so that only a portion of the yarn passes through the cutting mechanism such as illustrated knives 17.

Figures 4A, 4B, 4C:
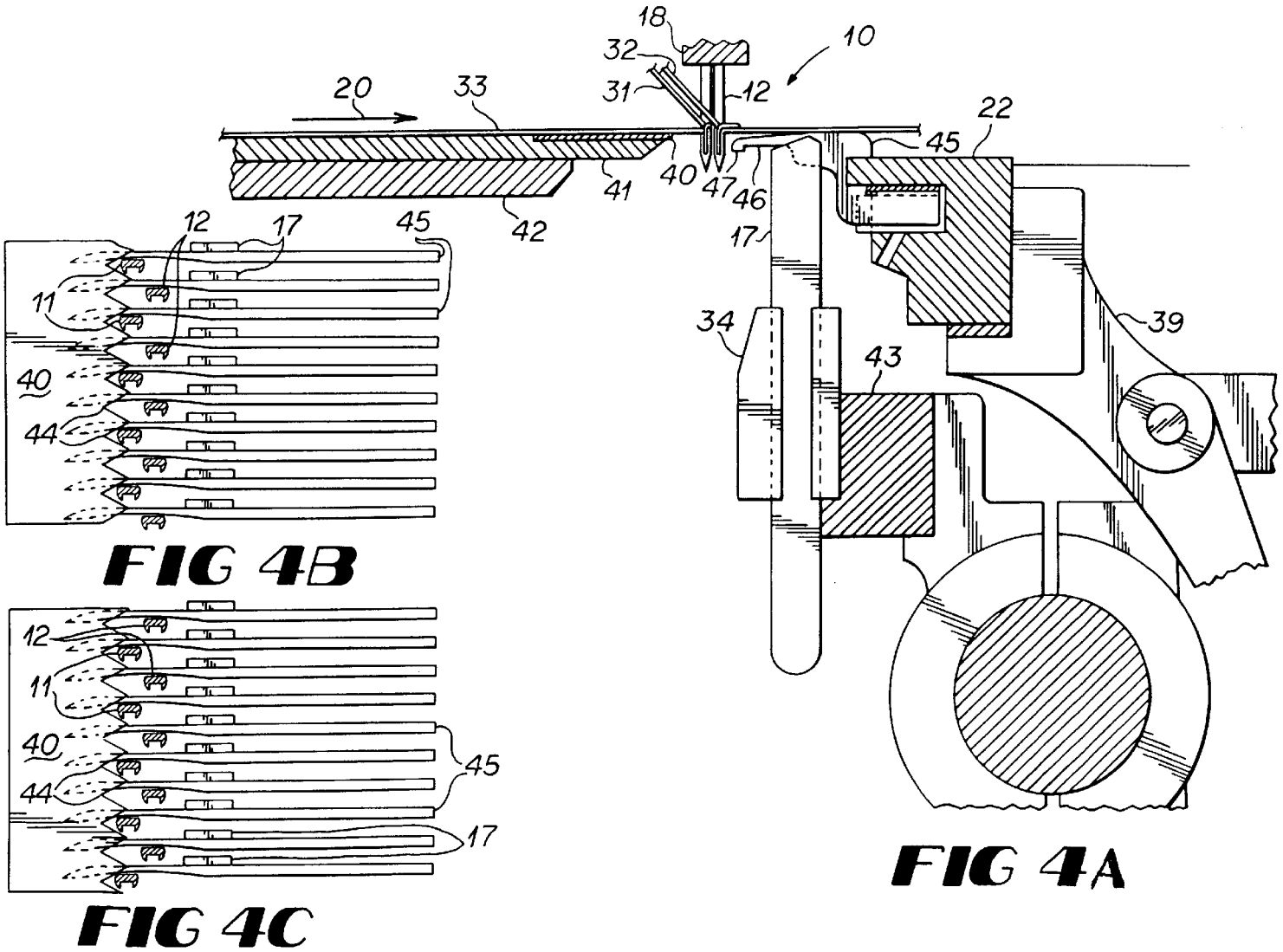
FIG. 4A is a side elevation view of a tufting machine with a staggered needle bar according to the present invention configured to produce cut pile carpet.
FIG. 4B is a top sectional view of the tufting machine of FIG. 4A showing the serrated edge of the needle plate and the loopers engaged to seize loops of yarn from the needles.
FIG. 4C is a top sectional view of the tufting machine of FIG. 4A showing the loopers engaged to seize loops of yarn from needles shifted one composite gauge unit from FIG. 4B.

Referring now to the present invention in detail, FIG. 4A discloses a staggered needle bar 18 supporting a first row of uniformly spaced rear needles 12 and a second row of uniformly spaced front needles 11 offset midway between the rear needles 12, to provide a uniform, narrow gauge, staggered needle tufting machine 10. To be considered narrow gauge or fine gauge, the transverse spacing between the needles in each row would be less than 0.25 inches and typically would be about 0.20 inches. The needle bar 18 is vertically reciprocated by conventional means, not shown, to cause the front and rear needles 11 and 12 to move between an upper position, not shown, above the base fabric 33, to a lower position penetrating the base fabric 33 so that the needles will carry yarns 31 and 32 through the base fabric 33 to form loops of tufting therein. The base fabric 33 is supported upon the needle plate 40 for movement, by means not shown in the direction of the arrow 20, longitudinally from front to rear through the machine.

Figure 9B:
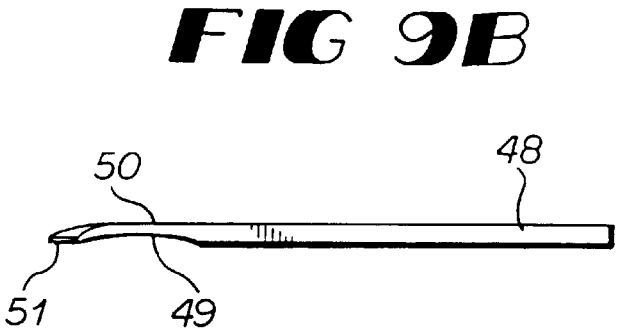
FIG. 9B is a top plan view of the hollow ground looper of FIG. 9A.

Hollow ground loopers 45 made in accordance with the invention are mounted in hook bar 22 which is fixed to rocker arms 39 journaled on a rocker shaft, not shown. The rocker shaft is driven by conventional means, not shown, and connected to the rocker arms 23 for limited reciprocable movement in synchronism with the reciprocable movement of needles 11 and 12. The hollow ground loopers 45 are cut pile hooks with downturned bills 47. The name "hollow ground" used in the context of hollow ground loopers is derived from the grinding of "hollows" 49 (shown in FIG. 9B) on the throats 46 (shown in FIG. 9A) of the loopers 45. The structural distinction between hollow ground loopers and standard loopers is the presence of a dished out section or hollow on the side of the throat of hollow ground loopers which passes across a corresponding needle.

When needles are in their lower position, hollow ground loopers 45 are moved forward toward the needles 11 and 12 until the downturned bills 47 have moved through the yarn loops carried by both the front and rear needles 11 and 12. Because the hollow ground loopers 45 have throats 46 of uniform length, each looper 45 may seize yarn loops from front needles 11 and rear needles 12. This allows for shifting of the staggered needle bar 18 in increments of the composite gauge of the front and rear needles 11 and 12. In order to facilitate the loopers' 45 crossing of the front needles 11 and rear needles 12 at the correct position to pick up the loops of yarn, front needles 11 which comprise the second row of needles crossed by the loopers 45 are lowered by between about 0.031 and 0.094 inches and preferably approximately 0.0625 inches. This is usually accomplished by setting the shanks of the rear needles 12 approximately 0.0625 inches deeper into the needle bar before engaging set screws to fix the position of the needles.

In order to minimize any corn-rowing effect and permit smoother, faster operation it is desirable that the rows of front needles 11 and rear needles 12 be longitudinally separated by only a very short distance, preferably approximately 0.125 inches in contrast to the usual staggered needle bar configuration where the rows of needles are longitudinally spaced by about at least 0.1875 inches. In this fashion, the number of loops of yarn retained on the loopers 45 will be relatively equal, varying by only one or two loops, regardless of whether the looper 45 is cooperating with front needles 11, rear needles 12 or both. The reduction of the longitudinal distance between rows of front and rear needles 11 and 12 has a similar beneficial effect in reducing a corn-rowed appearance even on conventional tufting machines in which front needles cooperate only with front loopers and rear needles cooperate only with rear loopers as illustrated in FIG. 1A.

Once the yarn loops are seized on the hollow ground loopers 45, yarn loops are moved in the direction of the fabric feed 20 toward a cutting apparatus, which in FIG. 4A consists of a knife 17 provided for and cooperating with each looper 45 to produce cut pile tufts. The knives 17 are mounted in knife blocks 34 carried upon a transverse knife bar 43 and driven synchronously by well known means to cause the needles 11 and 12, the loopers 45 and the knives 17 to cooperate to form cut pile tufts from the yarns 31 and 32.

The needle plate comprises a plurality of needle plate sections arranged end-to-end transversely of the tufting machine. Each needle plate section 40 is preferably made of a rectangular sheet of unitary solid material, such as spring steel, of thin gauge or thickness. The needle plate sections 40 are mounted upon an elongated mounting plate 41, supported in turn upon the bed plate 42 of the tufting machine. In the staggered needle arrangement as disclosed in FIGS. 4B and 4C, a plurality of open notches 44, preferably of uniform size and transverse spacing are formed in the trailing edge of the needle plate 16. A needle plate of this construction is disclosed in detail in U.S. Pat. No. 4,503,787.

FIGS. 4B and 4C show the hollow ground loopers 45 seizing loops of yarn from front needles 11 and rear needles 12 and the location of the needle plate 40 so that front needles 11 are positioned partially within notches 44. Notches 44 are formed to correspond to the composite gauge of the needle bar 18. FIG. 4B illustrates a section of ten hollow ground loopers 45 in a position seizing yarns from rear needles 12 and front needles 11. FIG. 4C is similar to FIG. 4B except that the needles 11 and 12 have been shifted one gauge step. Accordingly, the hollow ground loopers 45 that seized loops of yarn from front needles 11 in FIG. 4B are seizing loops of yarn from rear needles 12 in FIG. 4C. Similarly the hollow ground loopers 45 that seized loops of yarn from rear needles 12 in FIG. 43 are shown seizing loops of yarn from front needles 11 in FIG. 4C.

As a result, it is possible to shift needles 11, 12 in increments of the composite gauge of the front needles 11 and rear needles 12, rather than having to shift in increments of twice the composite gauge as shown in FIGS. 1A and 1B. This has the effect of reducing the amount of yarn used in the backstitch by an amount approximately equal to a unit of the composite gauge of front and rear needles 11 and 12. When this relatively small length of yarn is multiplied by the over 1200 front and rear needles 11 and 12 frequently found in a broadloom tufting machine and the hundreds of stitches made by each needle in even a single yard of carpet, the yarn savings become significant.

For instance, the yarn required for a 0.375 inch cut pile height stitch in a 0.10 inch composite gauge staggered needle bar tufting at a rate of 12 stitches per inch with a single composite gauge unit (0.10 inch) backstitch is 0.88 inches per needle. Since 0.75 inches represent the yarn forming the 0.375 inch cut pile surface (one 0.375 inch yarn going up and one 0.375 inch yarn coming down) only 0.13 inches of yarn is used in the backstitch. If the same stitch were shifted two composite gauge units (0.20 inches) for the backstitch the yarn required would be 0.967 inches, an increase of 9.9% in total yarn consumption. In this instance the back stitch yarn is 0.217 inches.

It should be clear that the same arrangement results in substantial savings even when the needles are shifted only intermittently as is sometimes done to increase machine speed or to achieve simple patterns. For instance in a tufting machine with 1620 needles divided between two staggered transverse rows forming a composite needle gauge of 0.10 inches and stitching a typical pattern (comprised of 12 straight or unshifted stitches and 6 shifted stitches in each repeat) at a density of 12 stitches per inch at a pile height of 0.375 inches, approximately 19,872 inches of backstitch yarn will be used per square yard of carpet if the needle bar is shifted in increments of 0.20 inches (twice the composite gauge). The same machine will use only approximately 16,602 inches of yarn per square yard if a comparable pattern (comprised of 10 straight stitches and 10 shifted stitches in each repeat) is created by shifting in increments of 0.10 inches. Thus typical carpet patterns tufted by shifting in increments of twice the composite gauge of the needle bar will utilize 19.7% more backstitch yarn than typical patterns made according to the present invention shifted in increments equal to the composite needle bar gauge.

Savings in backstitch yarn is significant because carpet manufacturers are particularly adverse to using excessive yarn on the backstitch where it contributes to neither the visual appearance nor wear characteristics of the carpet. In tufting machines with variable yarn feed mechanisms, such as those found in computer controlled tufting machines typified by Applicant's ENCORE machine, the backstitch savings constitute substantially all of the yarn savings. However, in tufting machines using less sophisticated fixed rate yarn feeds additional yarn savings are possible.

Fixed rate yarn feeds supply the same amount of yarn for each stitch regardless of whether the stitch is a straight unshifted stitch or a shifted stitch. The yarn supplied for each stitch must be the amount of yarn necessary for the type of stitch in the pattern requiring the greatest length of yarn. For instance, in a conventional tufting machine with two needle bars 13, 14 as shown in FIG. 1A, if the needles 11, 12 on each needle bar 13, 14 are spaced at 0.20 inch gauge for a composite 0.10 inch gauge, and yarn is tufted at a pile height of 0.375 inches at a rate of 12 stitches per inch, each straight stitch will consume 0.883 inches of yarn. Each shifted stitch must be shifted in multiples of two gauge units or 0.20 inches, and a shift of a single 0.20 inch unit will require the stitch to use 0.967 inches of yarn. In a typical pattern repeat comprised of 12 straight stitches and 6 shifted stitches each of the 18 stitches will be provided 0.967 inches of yarn. The straight stitches are provided with 0.134 inches more yarn than is actually required with the result that the height of the cut pile tufts created on the straight stitches is greater than the height of the cut pile tufts created by the shifted stitches. This creates an uneven appearance on the resulting carpet and tip shearing may be required to remove the extra yarn and provide a uniform appearance.

In a tufting machine with two 0.20 inch gauge staggered rows of needles in accordance with the present invention, the needle bar may be shifted in increments of the composite gauge or 0.10 inches. Accordingly, when yarn is tufted at a pile height of 0.375 inch at a rate of 12 stitches per inch, each straight stitch will consume 0.833 inches of yarn, just as would a conventional tufting machine, but each shifted stitch will require only 0.880 inches of yarn. Thus in a typical pattern repeat comprised of 10 straight stitches and 10 shifted stitches, each of the 20 stitches will be provided with only 0.880 inches of yarn rather than 0.967 inches as in a conventional tufting machine. The corresponding benefits are two-fold. First, total yarn consumption is reduced by 9% relative to a conventional tufting machine. Nearly one-fourth of this saving is related to the reduction in yarn used in the backstitch, while the remaining savings are due to less yarn being provided to form cut pile tufts of excessive height on straight stitched tufts. The second major benefit is that because the straight stitches are provided with only 0.880 inches of yarn, the extra yarn available on those stitches is only 0.047 inches. With such a reduced amount of extra yarn, the height of the cut pile tufts on both straight stitches and shifted stitches may be sufficiently uniform that tip shearing is not required.

In a tufting machine with two independently shiftable needle bars utilizing the present looper configuration, the longitudinal spacing between the row of front needles 11 and the row of rear needles 12 is preferably about 0.125 and 0.1563 inches. When the independently shiftable needle bars are comprised of cast modular needle blocks it may be possible to attain the 0.125 inch longitudinal spacing between the rows of front and rear needles. However, when the needles are mounted in drilled needle bar segments, it is generally necessary to use 0.1563 inch longitudinal spacing so that there is sufficient thickness in the supporting walls of the needle bar segments to hold the needles 11 and 12. Thus, it will be seen that the longitudinal spacing between the row of front needles and the row of rear needles will be between about 0.12 inches and 0.16 inches depending upon the method of constructing the needle bar(s) and whether the rows of needles are placed on one or two needle bars. Traditional staggered needle bars have longitudinally spaced the rows of needles by about at least 0.1875 inches, which aggravates the corn rowing effect. Indeed, longitudinal spacing of about 0.25 inches as described in U.K. Patent No. 1,438,173 is not uncommon.

The finished appearance of tufted carpet is very important. A drawback to the use of loopers with different length throats in the manufacture of cut pile carpet to seize yarns from different transverse rows of needles is that more loops of yarn will be held on loopers with long throats before being brought into contact with the knives. When the needles are retracted from the backing fabric for the backstitch, some tension is applied to those stitches still on the loopers with the result that stitches held on long throated loopers will often have a different height from stitches held on short throated loopers. The use of loopers of a uniform throat length with the transverse rows of needles spaced closely together keeps the number of yarn loops on each looper about the same and reduces the above described corn rowing effect.

It is a desire of tufting mills to operate their tufting machines at high speeds to increase the amount of carpet produces by each machine. An unshifted high speed tufting machine may be operated at over 1500 revolutions of the main drive shaft per minute, thereby producing over 1500 longitudinal stitches from each needle per minute. When a needle bar is shifted, the tufting machine must generally be run at slower speeds to allow time for the needle bar to move laterally while the needles are free from the backing fabric. Operating a high speed tufting machine with a shiftable needle bar to produce patterns with sizeable transverse shifts of 0.5 inches or more may require slowing the machine to less than 1000 rpm. By utilizing the invention to reduce the shifting of a staggered needle bar on a high speed tufting machine to a composite gauge unit, of say 0.10 inches, compared to a 0.20 inch gauge, it is expected that a mill should be able to increase its tufting machine speed by about 100 rpm or approximately 10%.

Figure 5:
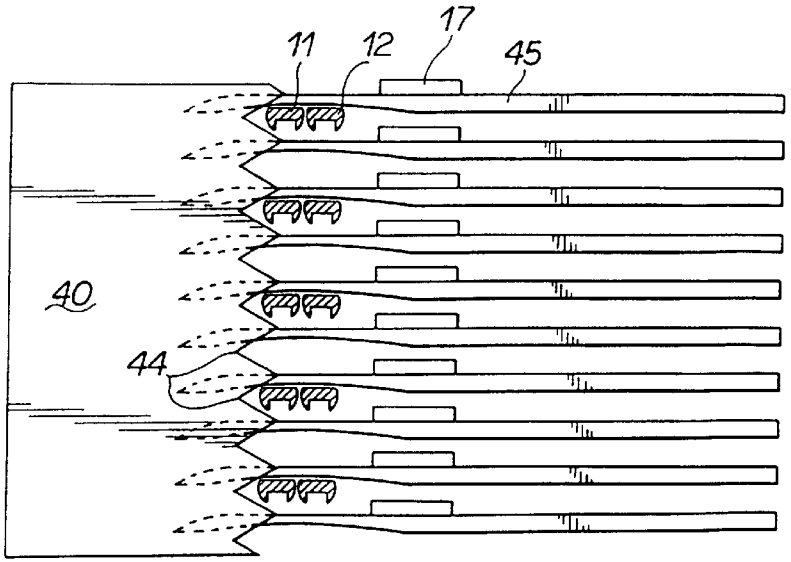
FIG. 5 is a top sectional view of a tufting machine with two independently shiftable needle bars, when the needles on both bars are longitudinally aligned and selected loopers are engaged to seize loops of yarn from the needles on both needle bars.

In a tufting machine with two independently shiftable needle bars, it is possible to align the front needles 11 and rear needles 12 as shown in FIG. 5. FIG. 5 shows alternate hollow ground loopers 45 seizing loops of yarn from both front needles 11 and rear needles 12 in the same stitch cycle. This configuration would not be achieved when a single staggered needle bar is used.

The hollow ground loopers 45 are adapted to seize loops of yarn from either front needles 11, rear needles 12, or both as shown in FIGS. 4B, 4C and 5 due to two design innovations shown in detail in FIGS. 7 and 9 and contrasted with prior art designs in FIGS. 6 and 8. FIGS. 6A–E shows a tufting needle 55 of standard design. The needle 55 has a shank 56 which is received in the needle bar, a flattened blade portion 57, a bevel 59 at the front of the scarf 60, a pick up spot 61, an aperture 63, a yarn groove 58 and a point 62. Tufting needles 55 would typically be used on the row of needles crossed first by the loopers, which in the case of a cut pile tufting machine would be the rear needles 12. FIGS. 7A–E illustrate a needle 65 designated as a Maximum Target Area ("MTA") needle and commercially available from Singer Corporation. The most notable distinction between standard needle 55 and MTA needle 65 is visible by comparing FIGS. 6D and 7D. It will be seen that the scarf 70 of the MTA needle 65 is thicker than the scarf 60 of the standard needle 55. The thicker scarf 70 results in a needle which is somewhat stiffer and more resistant to deflection than a standard needle 55. The thicker scarf 70 also allows a greater bevel 69 at the front of the scarf 70. An important result of the thicker scarf 70 is that it has the effect of moving the yarn pickup spot 71 slightly towards the looper by a distance equal to the increased scarf thickness. Thus even if the points 72 of the second row of MTA needles 65 are exactly on gauge and aligned with the points 62 of a first row of standard needles 55, the yarn pick up spots 71 of the MTA needles 65 will be somewhat closer to the corresponding looper, much as if the second row of needles were offset as suggested in U.S. Pat. No. 3,443,534. Because of the greater bevel 69, loopers 45 can cross the yarn pickup spot 71 when the first and second rows of needles are staggered and there is no deflection.

Figure 9A:
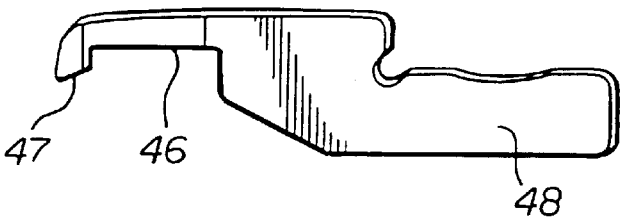
FIG. 9A is a side view of a hollow ground looper according to the present invention.
Figure 8B:
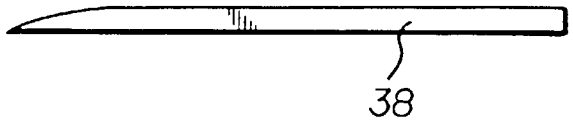
FIG. 8B is a top plan view of a standard looper used on a tufting machine to form cut pile loops.
Figure 8A:
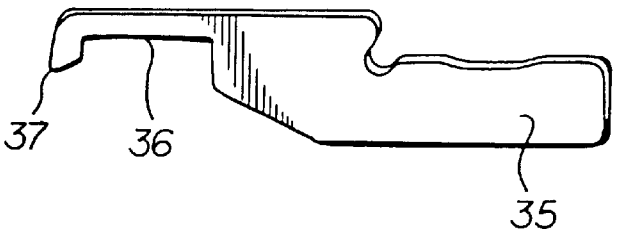
FIG. 8A is a side view of a standard looper used on a tufting machine for cut pile loops.

FIG. 8A illustrates a standard cut pile looper 35, with throat 36 and downturned bill 37. As shown in FIG. 8B, the top edge 38 of the looper is of uniform thickness of about 0.050 inches from the rear tang 54 up to the tapered section toward the point of the bill 37. FIGS. 9A and B illustrate the hollow ground looper 45 used in the present invention. The needle facing side of the throat 46 of the hollow ground looper 45 has been shaped by grinding a slightly arcuate hollow 49 that reduces the thickness of the throat 46 from about 0.050 inches to a thickness of between 0.035 and 0.020 inches and preferably about 0.025 inches. The opposite side of the throat 46 is also ground so that a radius is formed to the looper point 51. In operation, when the looper point 51 passes the first needle 55, and is deflected somewhat, the hollow 49 in the needle side of the throat 46 allows the looper point to return nearly to its original orientation before the deflection occurred. The narrowness of the looper point 51 and the deflection reduction achieved by the hollow 49 enable hollow ground loopers 45 to avoid being deflected into the second row of needles as happens to standard loopers as shown in FIG. 3C, and to avoid missing yarn pickups as shown in FIG. 3D. The thicker scarf 70 of MTA needles 65 also helps move the yarn pick up spot 71 of the MTA needles 65 so that in the event of a small amount of deflection, the hollow ground loopers 45 still effectively seize loops of yarn without splitting.

Numerous alterations of the structures and methods herein described will suggest themselves to those skilled in the art. It will be understood that the details and arrangements of the parts and methods that have been described and illustrated in order to explain the nature of the invention are not to be construed as any limitation of the invention. All such alterations which do not depart from the spirit of the invention are intended to be included within the scope of the appended claims.

What is claimed is:

1. A tufting machine comprising:

a. a mechanism for moving a base fabric longitudinally through said machine in a feeding direction;

b. a single staggered needle bar having both a first row and a second row of needles uniformly spaced transversely of the feeding direction, said second row of needles being longitudinally spaced from said front row of needles by about 0.120 to 0.160 inches, and being uniformly and transversly staggered relative to said first needles, to form a uniform narrow composite gauge;

c. a needle drive for reciprocating said needle bar toward and away from a first side of said base fabric to cyclically penetrate said base fabric;

d. a single row of hollow ground loopers disposed transversely to the feeding direction and adjacent the base fabric on a second side opposite said base fabric from the needle bar, said hollow ground loopers having throats of substantially the same length and being spaced apart transversly by a distance substantially equal to the composite gauge of the first and second rows of needles;

e. a needle bar shifting mechanism operatively connected to said needle bar to transversly shift the needle bar by multiples of the composite gauge of the first and second rows of needles; and f. a looper drive operatively connected to said row of hollow ground loopers for cyclically reciprocating said hollow ground loopers between an engaged loop seizing position with said first and second rows of needles when said needles have penetrated the base fabric, and an unengaged position when said needles are reciprocated away from the first side of said base fabric.

2. The tufting machine according to claim 1 in which the hollow ground loopers have a throat and a bill, and said throat has a first needle facing side and a second opposite side, wherein the first needle facing side has an arcuate hollow of approximately 0.015 to 0.03 inches maximum depth.

3. The tufting machine according to claim 2 in which the second opposite side of the hollow ground loopers is arcuately tapered to a point at the bill of the looper.

4. The tufting machine according to claim 1 further comprising a cutting apparatus for cutting loops of yarn seized upon said hollow ground loopers.

5. The tufting machine according to claim 1 wherein the uniform transverse spacing between needles in said first row is less than 0.25 inches.

6. A tufting machine comprising:

a. a mechanism for moving a base fabric longitudinally through said machine in a feeding direction;

b. a single staggered needle bar having both a first row and a second row of needles uniformly spaced transversly of the feeding direction, said second row of needles being longitudinally spaced less than 0.160 inches from said front row of needles, and being uniformly and transversly staggered relative to said first needles, to form a uniform narrow composite gauge;

c. a needle drive for reciprocating said needle bar toward and away from a first side of said base fabric to cyclically penetrate said base fabric;

d. at least one row of loopers disposed transversly to the feeding direction and adjacent the base fabric on a second side opposite said base fabric from the needle bar, said loopers having throats of substantially the same length and being spaced apart transversly by a distance substantially equal to the composite gauge of the first and second rows of needles;

e. a needle bar shifting mechanism operatively connected to the needle bar to transversely shift said needle bar; and f. a looper drive operatively connected to said loopers for cyclically reciprocating said loopers between an engaged loop seizing position with said first and second rows of needles when said needles have penetrated the base fabric, and an unengaged position when said needles are reciprocated away from the first side of said base fabric.

7. The tufting machine of claim 6 wherein the loopers are hollow ground loopers.

8. The tufting machine of claim 6 wherein the needles of the first and second rows of needles have yarn pick up spots and the needles of the second transverse row of needles are positioned to locate the yarn pick up spots of said second transverse row of needles between approximately 0.03125 and 0.09375 inches lower than the yarn pick up spots of said first row of transverse needles.

9. The tufting machine according to claim 7 in which the hollow ground loopers have a throat and a bill, and said throat has a first needle facing side and a second opposite side, wherein the first needle facing side has an arcuate hollow of approximately 0.015 to 0.03 inches maximum depth.

10. The tufting machine according to claim 7 in which the second opposite side of the hollow ground loopers is arcuately tapered to a point at the bill of the looper.

11. The tufting machine according to claim 6 further comprising a cutting apparatus for cutting loops of yarn seized upon said hollow ground loopers.

12. The tufting machine according to claim 6 wherein the uniform transverse spacing between needles in said first row is less than 0.25 inches.

13. A tufting machine comprising:

a. a mechanism for moving a base fabric longitudinally through said machine in a feeding direction;

b. a staggered needle bar having a first row and a second row of needles uniformly spaced transversely of the feeding direction, said second row of needles being longitudinally spaced from said front row of needles, and being uniformly and transversely staggered relative to said first needles, to form a uniform narrow composite gauge;

c. a needle drive for reciprocating said needle bar toward and away from a first side of said base fabric to cyclically penetrate said base fabric;

d. a single row of loopers disposed transversely to the feeding direction and adjacent the base fabric on a second side opposite said base fabric from the needle bar, said loopers having throats of substantially the same length and being spaced apart transversely by a distance substantially equal to the composite gauge of the first and second rows of needles;

e. a needle bar shifting mechanism operatively connected to said needle bar to transversely shift the needle bar by multiples of the composite gauge of the first and second rows of needles; and f. a looper drive operatively connected to said row of loopers for cyclically reciprocating said loopers between an engaged loop seizing position with said first and second rows of needles when said needles have penetrated the base fabric, and an unengaged position when said needles are reciprocated away from the first side of said base fabric;

Wherein the needles of the second transverse row of needles have a relatively thicker scarf than the needles of the first transverse row of needles.

14. The tufting machine according to claim 13 in which the longitudinal spacing between the first and second row of transversely spaced needles is between approximately $^{12}/_{100}$ and $^{16}/_{100}$ inches.

15. The tufting machine according to claim 13 in which the loopers are hollow ground loopers which have a throat and a bill, and said throat has a first needle facing side and a second opposite side, wherein the first needle facing side has an arcuate hollow of approximately 0.015 to 0.03 inches maximum depth.

16. The tufting machine according to claim 15 in which the second opposite side of the hollow ground loopers is arcuately tapered to a point at the bill of the looper.

17. The tufting machine according to claim 13 further comprising a cutting apparatus for cutting loops of yarn seized upon said loopers.

18. The tufting machine according to claim 13 wherein the uniform transverse spacing between needles in said first row is less than ¼ inch.

19. A tufting machine comprising:

a. a mechanism for moving a base fabric longitudinally through said machine in a feeding direction;

b. a staggered needle bar having a first row and a second row of needles uniformly spaced transversely of the feeding direction, said second row of needles being longitudinally spaced from said front row of needles, and being uniformly and transversely staggered relative to said first needles, to form a uniform narrow composite gauge;

c. a needle drive for reciprocating said needle bar toward and away from a first side of said base fabric to cyclically penetrate said base fabric;

d. a single row of loopers disposed transversely to the feeding direction and adjacent the base fabric on a second side opposite said base fabric from the needle bar, said loopers having throats of substantially the same length and being spaced apart transversely by a distance substantially equal to the composite gauge of the first and second rows of needles;

e. a needle bar shifting mechanism operatively connected to said needle bar to transversely shift the needle bar by multiples of the composite gauge of the first and second rows of needles; and f. a looper drive operatively connected to said row of loopers for cyclically reciprocating said loopers between an engaged loop seizing position with said first and second rows of needles when said needles have penetrated the base fabric, and an unengaged position when said needles are reciprocated away from the first side of said base fabric;

Wherein the needles of the second transverse row of needles are positioned so that yarn pickup spot is between approximately $^{1}/_{32}$ and $^{3}/_{32}$ inches lower than the yarn pick up spots of the first row of tranverse needles.

20. The tufting machine according to claim 19 in which the longitudinal spacing between the first and second row of transversely spaced needles is between approximately $^{12}/_{100}$ and $^{16}/_{100}$ inches.

21. The tufting machine according to claim 19 in which the loopers are hollow ground loopers which have a throat and a bill, and said throat has a first needle facing side and a second opposite side, wherein the first needle facing side has an arcuate hollow of approximately 0.015 to 0.03 inches maximum depth.

22. The tufting machine according to claim 21 in which the second opposite side of the hollow ground loopers is arcuately tapered to a point at the bill of the looper.

23. The tufting machine according to claim 19 further comprising a cutting apparatus for cutting loops of yarn seized upon said loopers.

24. The tufting machine according to claim 19 wherein the uniform transverse spacing between needles in said first row is less than ¼ inch.

25. A tufting machine comprising:

a. a mechanism for moving a base fabric longitudinally through said machine in a feeding direction;

b. first elongated needle bar extending transversely relative to said feed direction carrying a first plurality of needles spaced apart by a first distance;

c. a second elongated needle bar extending transversely relative to said feed direction substantially parallel to said first needle bar carrying a second plurality of needles spaced apart transversely by a second distance, said second plurality of needles being longitudinally spaced from said first plurality of needles;

d. a needle drive for reciprocating said needle bar toward and away from a first side of said base fabric to cyclically penetrate said base fabric;

e. a single row of loopers disposed transversely to the feeding direction adjacent the base fabric on a second side opposite said base fabric from the needle bar, said loopers having throats of substantially the same length and being spaced apart transversely by a distance substantially equal to the composite gauge of the first and second rows of needles;

f. a needle bar shifting mechanism operatively connected to said first needle bar to transversely shift the first needle bar by multiples of the composite gauge of the first and second pluralities of needles;

g. a needle bar shifting mechanism operatively connected to said second needle bar to transversely shift the second needle bar by multiples of the composite gauge of the first and second pluralities of needles; and h. a looper drive operatively connected to said row of loopers for cyclically reciprocating said loopers between an engaged loop seizing position with said first and second pluralities of needles when said needles have penetrated the base fabric, and an unengaged position when said needles are reciprocated away from the first side of said base fabric;

Wherein the needles of the second plurality of needles have a relatively thicker scarf than the scarf of the first plurality of needles.

26. The tufting machine according to claim 25 in which the longitudinal spacing between the first and second pluralities of transversely spaced needles is between approximately 0.120 and 0.160 inches.

27. The tufting machine according to claim 25 in which the loopers are hollow ground loopers which have a throat and a bill, and said throat has a first needle facing side and a second opposite side, wherein the first needle facing side has an arcuate hollow of approximately 0.015 to 0.030 inches maximum depth.

28. The tufting machine according to claim 27 in which the second opposite side of the hollow ground loopers is arcuately tapered to a point at the bill of the looper.

29. The tufting machine according to claim 25 in which said first distance is equal to said second distance.

30. The tufting machine according to claim 25 further comprising a cutting apparatus for cutting loops of yarn seized upon said hollow ground loopers.

31. The tufting machine according to claim 25 in which said first distance is less than 0.25 inches.

32. A tufting machine comprising:

a. a mechanism for moving a base fabric longitudinally through said machine in a feeding direction;

b. first elongated needle bar extending transversely relative to said feed direction carrying a first plurality of needles spaced apart by a first distance;

c. a second elongated needle bar extending transversely relative to said feed direction substantially parallel to said first needle bar carrying a second plurality of needles spaced apart transversely by a second distance, said second plurality of needles being longitudinally spaced from said first plurality of needles;

d. a needle drive for reciprocating said needle bar toward and away from a first side of said base fabric to cyclically penetrate said base fabric;

e. a single row of loopers disposed transversely to the feeding direction adjacent the base fabric on a second side opposite said base fabric from the needle bar, said loopers having throats of substantially the same length and being spaced apart transversely by a distance substantially equal to the composite gauge of the first and second rows of needles;

f. a needle bar shifting mechanism operatively connected to said first needle bar to transversely shift the first needle bar by multiples of the composite gauge of the first and second pluralities of needles;

g. a needle bar shifting mechanism operatively connected to said second needle bar to transversely shift the second needle bar by multiples of the composite gauge of the first and second pluralities of needles; and h. a looper drive operatively connected to said row of loopers for cyclically reciprocating said loopers between an engaged loop seizing position with said first and second pluralities of needles when said needles have penetrated the base fabric, and an unengaged position when said needles are reciprocated away from the first side of said base fabric;

Wherein the needles of the second plurality of needles are positioned so that the yarn pick up-spot is between approximately 1/32 and 3/32 inches lower than the yarn pick up spots of the first plurality of needles.

33. The tufting machine according to claim 32 in which the longitudinal spacing between the first and second pluralities of transversely spaced needles is between approximately 0.120 and 0.160 inches.

34. The tufting machine according to claim 32 in which the loopers are hollow ground loopers which have a throat and a bill, and said throat has a first needle facing side and a second opposite side, wherein the first needle facing side has an arcuate hollow of approximately 0.015 to 0.030 inches maximum depth.

35. The tufting machine according to claim 32 in which the second opposite side of the hollow ground loopers is arcuately tapered to a point at the bill of the looper.

36. The tufting machine according to claim 32 in which said first distance is equal to said second distance.

37. The tufting machine according to claim 32 further comprising a cutting apparatus for cutting loops of yarn seized upon said hollow ground loopers.

38. The tufting machine according to claim 32 in which said first distance is less than 0.25 inches.

39. A tufting machine comprising:

a. a mechanism for moving a base fabric longitudinally through said machine in a feeding direction;

b. a staggered needle bar having a first row and a second row of needles uniformly spaced transversely of the feeding direction, said second row of needles being longitudinally spaced less than about 5/32 inches from said front row of needles, and being uniformly and transversely staggered relative to said first needles, to form a uniform narrow composite gauge wherein the needles of the first and second rows of needles have yarn pick up and the needles of the second transverse row of needles are positioned to locate the yarn pick up spots of said second transverse row of needles between approximately 0.03125 and 0.09375 inches lower than the yarn pick up spots of said first row of transverse needles;

c. a needle drive for reciprocating said needle bar toward and away from a first side of said base fabric to cyclically penetrate said base fabric;

d. at least one row of loopers disposed transversely to the feeding direction and adjacent the base fabric on a second side opposite said base fabric from the needle bar, said loopers being spaced apart transversely by a distance substantially equal to the composite gauge of the first and second rows of needles;

e. a needle bar shifting mechanism operatively connected to the needle bar to transversely shift said needle bar; and f. a looper drive operatively connected to said loopers for cyclically reciprocating said loopers between an engaged loop seizing position with said first and second rows of needles when said needles have penetrated the base fabric, and an unengaged position when said needles are reciprocated away from the first side of said base fabric.

* * * * *